US008743155B2

(12) United States Patent
Ishii et al.

(10) Patent No.: US 8,743,155 B2
(45) Date of Patent: Jun. 3, 2014

(54) CIRCUIT AND DRIVING METHOD FOR CORRECTING TONE OUTPUT OF A PIXEL

(75) Inventors: Masato Ishii, Tokyo (JP); Naruhiko Kasai, Yokohama (JP); Hajime Akimoto, Kokubunji (JP)

(73) Assignees: Japan Display Inc., Tokyo (JP); Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 12/849,136

(22) Filed: Aug. 3, 2010

(65) Prior Publication Data

US 2011/0050747 A1 Mar. 3, 2011

(30) Foreign Application Priority Data

Aug. 26, 2009 (JP) ..... 2009-194982

(51) Int. Cl.
*G09G 5/10* (2006.01)
*G09G 3/36* (2006.01)

(52) U.S. Cl.
USPC ..... 345/690; 345/89; 345/204

(58) Field of Classification Search
USPC ..... 345/204–215, 690–699
See application file for complete search history.

(56) References Cited

U.S. PATENT DOCUMENTS

| | | | | |
|---|---|---|---|---|
| 6,980,189 | B2 * | 12/2005 | Maruoka et al. | 345/94 |
| 7,239,297 | B2 * | 7/2007 | Tajima et al. | 345/89 |
| 2002/0005862 | A1 * | 1/2002 | Deering | 345/694 |
| 2004/0135798 | A1 * | 7/2004 | Someya et al. | 345/690 |
| 2005/0052350 | A1 * | 3/2005 | Mizukoshi et al. | 345/55 |
| 2005/0174343 | A1 * | 8/2005 | Maeyama et al. | 345/204 |
| 2006/0038501 | A1 | 2/2006 | Koyama et al. | |
| 2006/0061560 | A1 * | 3/2006 | Yamashita et al. | 345/204 |
| 2008/0158443 | A1 * | 7/2008 | Shiomi | 348/790 |
| 2008/0291224 | A1 * | 11/2008 | Ishii et al. | 345/690 |
| 2009/0051628 | A1 * | 2/2009 | Kwon | 345/77 |
| 2009/0237423 | A1 * | 9/2009 | Shih et al. | 345/690 |
| 2010/0026731 | A1 * | 2/2010 | Konuma | 345/690 |
| 2010/0045650 | A1 * | 2/2010 | Fish et al. | 345/211 |

FOREIGN PATENT DOCUMENTS

| | | |
|---|---|---|
| JP | 2003-174601 | 6/2003 |
| JP | 2006-091709 | 4/2006 |
| JP | 2006-091860 | 4/2006 |

* cited by examiner

*Primary Examiner* — Kent Chang
*Assistant Examiner* — William Lu
(74) *Attorney, Agent, or Firm* — Antonelli, Terry, Stout & Kraus, LLP.

(57) ABSTRACT

A display device capable of correcting display of deteriorated pixels without causing a nonconstant tonality or improper color balance is provided. The display device includes a display section with plural pixels; signal lines; a data generation circuit; a D/A converter for sequentially converting a tone data to an analog voltage and outputting the analog voltage to the signal lines; a switch circuit for outputting a signal corresponding to the pixel state by switching the signal lines; an A/D converter for sequentially detecting the signal; and a detection circuit for estimating the state of the pixel from the signal. The D/A converter includes an output range setting means for setting an allowed output range of the analog voltage. The display device includes an output correction circuit that controls the output range setting means in accordance with the state of the pixel detected by the detection circuit.

13 Claims, 13 Drawing Sheets

| 53 | 54 | 55 |
|---|---|---|
| DETERIORATION RATIO [%] | DETECTION VOLTAGE [mV] | CORRECTION VOLTAGE [mV] |
| ~1[%] | 0[mV] | 0[mV] |
| 1~2[%] | 15[mV] | 10[mV] |
| 2~3[%] | 30[mV] | 20[mV] |
| 3~ [%] | 45[mV] | 30[mV] |

CIRCUIT AND DRIVING METHOD FOR CORRECTING TONE OUTPUT OF A PIXEL

CLAIM OF PRIORITY

The present application claims priority from Japanese application JP 2009-194982 filed on Aug. 26, 2009, the content of which is hereby incorporated by reference into this application.

BACKGROUND OF THE INVENTION

1. Field of the Invention

The present invention relates to a display device, and for example, to a display device the display elements of which are constructed by self-emitting elements.

2. Description of the Related Art

With the spread of various information processing apparatuses, display devices come in various forms in accordance with their functions. Among them, so-called self-emitting type display devices in which display elements are constructed by self-emitting elements are gathering attention. In such display devices, a display device in which organic electro-luminescence (EL) elements or organic light-emitting diodes, for example, are used as the display elements thereof is known. Such a display device is directed to reduce power consumption since a backlight is not needed and has advantages such as high visibility of pixels and faster response compared to liquid-crystal displays of the related art. In addition, such a display device has properties similar to diodes, and thus, luminance thereof can be controlled by the amount of current flowing through the elements. Such a self-emitting display device is described, for example, in JP 2006-91709 A.

However, in the display device having such a configuration, the light-emitting elements thereof generally have such properties that the internal resistance of the elements changes with the use period and ambient atmosphere. Particularly, as the use period increases, the internal resistance will increase with time, and the amount of current flowing through the elements also decreases. Therefore, for example, when pixels at the same position in the screen are continuously lighted when displaying a menu window on the screen, a burn-in phenomenon occurs in that portion. In order to correct this state, it is necessary to detect the states of the pixels. In this detection method, the states of the pixels are detected in the display blanking period. In the blanking period, since pixels are not lighted, no voltage is applied. Therefore, by using an additional power source different from a power source used for lighting to apply a predetermined current to pixels during the blanking period and detect a voltage in the current-applied state, the burn-in-related deterioration is detected from a change in the voltage.

As a method of detecting and correcting the pixel state, as disclosed in JP 2006-91860 A, for example, a method is known in which monitoring elements are arranged in parallel in each row direction of the light-emitting elements of a display section, and a main current source supplies a constant current to the monitoring elements so that a voltage generated in the monitoring element is applied to plural light-emitting elements arranged in the row direction in parallel to the monitoring element, and the light-emitting elements are driven with a constant voltage.

JP 2003-174601 A discloses another method in which by driving a display region in accordance with time, a slope of a burn-in at the boundary between a video display portion and a mask portion is made dull, and a difference in the luminance and color of the video near the boundary is made inconspicuous when the video is displayed in full mode.

The display device disclosed in JP 2003-174601 A makes a difference in the luminance and color of the video near the boundary between the burned-in portion and a nonburned-in portion inconspicuous as described above and is able to relieve the burn-in itself but is unable to solve it. Moreover, when the burn-in phenomenon is corrected by detecting the pixel state and correcting the luminance deterioration between adjacent pixels, the tonality will be nonconstant and color balance will become improper if the burned pixels are simply corrected without discrimination.

SUMMARY OF THE INVENTION

The invention has been made in view of the circumstances described above, and an object of the invention is to provide a display device capable of correcting the display of deteriorated pixels without causing a nonconstant tonality or improper color balance.

In order to solve the above-mentioned problems, according to an aspect of the invention, there is provided a display device including: a display section in which plural pixels the emission amount of which changes with a current amount are formed in a matrix form in first and second directions; signal lines for inputting display signal voltages to the pixels; a data generation circuit for generating tone data of the respective pixels from display data supplied from an external device; a D/A converter for sequentially converting the tone data to an analog voltage and outputs the analog voltages to the signal lines; a switch circuit for outputting a signal corresponding to the pixel state of the pixel obtained in response to supply of detection power to the pixel by switching the signal lines; an A/D converter for sequentially detecting the signal corresponding to the pixel state of the pixel along the first direction; and a detection circuit for estimating the state of the pixel from the signal detected by the A/D converter, wherein the D/A converter includes an output range setting means for setting an allowed output range of the analog voltage to be output in accordance with the tone data, and the display device includes an output correction circuit for controlling the output range setting means so that the allowed output range of the analog voltages corresponding to the respective pixels is changed and set in accordance with the state of the pixel detected by the detection circuit.

In order to solve the above-mentioned problems, according to another aspect of the invention, there is provided a display device including: a display section in which plural pixels the emission amount of which changes with a current amount are formed in a matrix form in first and second directions; signal lines for inputting display signal voltages to the pixels; a data generation circuit for generating tone data of the respective pixels from display data supplied from an external device; a D/A converter for sequentially converting the tone data to an analog voltage and outputting the analog voltage to the signal lines; a switch circuit for outputting a signal corresponding to the pixel state of the pixel obtained in response to supply of detection power to the pixel by switching the signal lines; an A/D converter for sequentially detecting the signal corresponding to the pixel state of the pixel along the first direction; and a detection circuit for estimating the state of the pixel from the signal detected by the A/D converter, wherein the D/A converter includes an output range setting means for setting an allowed output range of the analog voltage to be output in accordance with the tone data, and the display device includes an output correction circuit for controlling the output range setting means so that the allowed output range of the analog voltages corresponding respective pixels in each group of pixels which are formed along the first or second direction is changed and set in accordance with the state of the pixel detected by the detection circuit.

According to the display device of the above aspects of the invention, it is possible to correct the display of deteriorated pixels without causing a nonconstant tonality or improper color balance. In addition, since the correction is made at positions between adjacent pixels where burn-in is the greatest, when the pixels on the entire screen are deteriorated substantially uniformly, it is possible to obtain an extraordinary advantage that a long-term burn-in phenomenon can be corrected.

These and other objects and novel features of the invention will become apparent from the entire description of this specification.

DETAILED DESCRIPTION OF THE INVENTION

Figure 1:
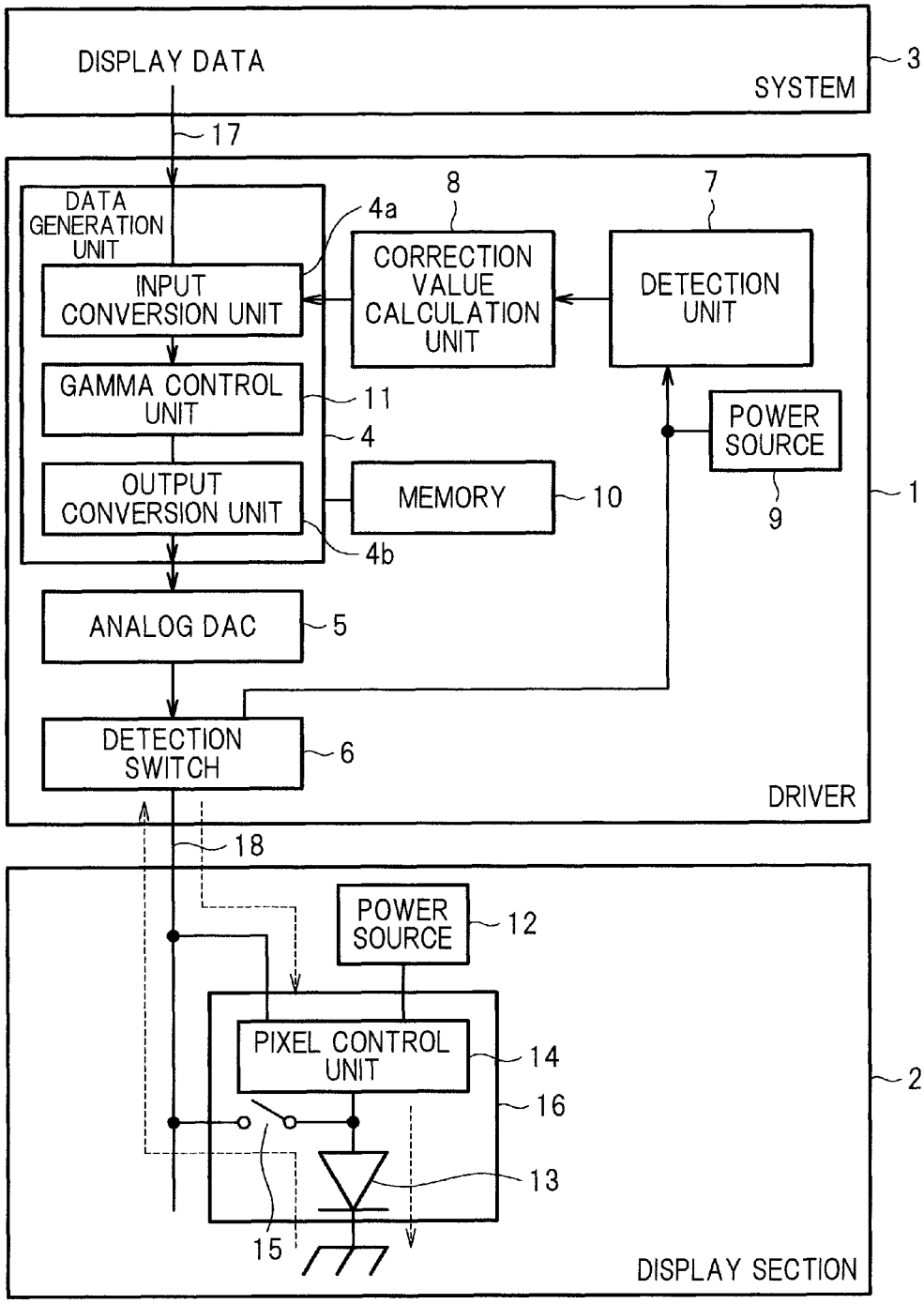
FIG. 1 is a schematic diagram showing a configuration of a display device according to a first embodiment of the invention.

Hereinafter, embodiments of the invention will be described with reference to the drawings. In the respective drawings and embodiments, the same or similar constituent elements will be denoted by the same reference numerals, and description thereof will be omitted.

First Embodiment

Overall Configuration

FIG. 1 is a schematic diagram showing a configuration of a display device according to a first embodiment of the invention. As shown in FIG. 1, a display device of the first embodiment includes a driver 1, a display section 2, and a system 3 that interworks with the driver 1 and display section 2. The driver 1 includes a data generation unit 4, an analog DAC (D/A converter) 5, a detection switch 6, a detection unit 7, a correction value calculation unit 8, and a detection power source 9. The data generation unit 4 includes a memory 10 for arithmetic processing and a gamma control unit 11 that performs gamma adjustment of video signals as one of arithmetic processing. The display section 2 includes a display power source 12, a display element 13, pixel control units 14, and switches 15. One unit pixel for color display includes three pixels in total, which are a pixel 16 having a red (R) display element 13, a pixel 16 having a green (G) display element 13, and a pixel 16 having a blue (B) display element 13. The respective display elements 13 are connected to the corresponding pixel control unit 14 and the corresponding switches 15. The unit pixels for color display are formed in a matrix form in the horizontal direction (first direction) and the vertical direction (second direction) of the display section 2. The display device of the first embodiment is a display device in which organic EL elements are used as the display elements 13, for example.

Display data from the system 3 which is an external system are input to the data generation unit 4 of the driver 1 through a signal line 17. The data generation unit 4 controls the timings and signals of the display data. Particularly, in the data generation unit 4 of the first embodiment, the gamma control unit 11 performs gamma correction, which is tone correction based on the gamma characteristic of the display section 2, with respect to image data converted by an input converter 4*a*. Moreover, when performing the gamma correction, the gamma control unit 11 performs correction corresponding to the output from the correction value calculation unit 8, namely correction based on the degree of deterioration of pixels, with respect to the image data. Furthermore, the gamma control unit 11 corrects a tone dynamic range of the analog DAC 5 as the correction corresponding to the output from the correction value calculation unit 8. In addition, tone correction and color correction with respect to image data after the gamma correction, which are well known in the related art, are performed by an output converter 4*b*. That is to say, the gamma correction with respect to the image data by the gamma control unit 11 and the correction with respect to the image data based on the degree of deterioration of pixels are performed by a correction method which is well known in the related art.

As described above, the gamma control unit 11 of the first embodiment performs the gamma correction with respect to tone data of each pixel corresponding to the image data and correction of the tone dynamic range of the analog DAC 5. The configuration of the gamma control unit 11 is not limited to the above-described configuration, and for example, the gamma control unit 11 may perform only correction of the tone dynamic range of the analog DAC 5.

The detection switch 6 performs switching of a data flow direction during display and detection. The power source for driving the display elements 13 takes independent forms which are different from during detection to during display. That is, the detection power source 9 is used during detection, and the display power source 12 is used during display. The display power source 12 is preferably common to the display elements 13 contributing to display. In the present embodiment, although two power sources are used and shown, the number of power sources may be increased or decreased in accordance with the system configuration, and the power source may be constructed by a current source and a voltage source.

The detection unit 7 includes a buffer and an A/D converter which are not shown but well known in the related art. In the detection unit 7, after detection voltages which are analog values input through the detection switch 6 are amplified by the buffer, the A/D converter converts the analog values to digital signals and appropriately output the digital signals to the correction value calculation unit 8.

Based on detection values converted to the digital signals, the correction value calculation unit 8 calculates a difference value between adjacent pixels and calculates a correction amount based on the difference value. The obtained correction amount is output to the data generation unit 4 and temporarily stored in the memory 10 of the data generation unit 4.

The flow of signals in the driver 1 can be roughly grasped in three paths, which are a display path, a detection path, and a correction path. The display path is a flow wherein the display data are supplied to the display section 2 through the data generation unit 4 and the detection switch 6, whereby the display elements 13 are driven by the display power source 12 under the control of the pixel control units 14. The detection path is a flow wherein the display data are supplied from the display elements 13 to the detection unit 7 through the switch 15 and the detection switch 6. The correction path is a flow wherein the display data are supplied from the detection unit 7 to the data generation unit 4 through the correction value calculation unit 8 whereby the tone data and the tone dynamic range of the analog DAC 5 are corrected. In this case, the driver 1 and the display section 2 transmit and receive the signals through the signal line 18. The details of the correction of the tone dynamic range of the analog DAC 5, namely the correction of an allowed output range of the analog voltage output based on the tone data will be described later.

[Configuration of Panel that Performs Display and Detection Operations]

Figure 2:
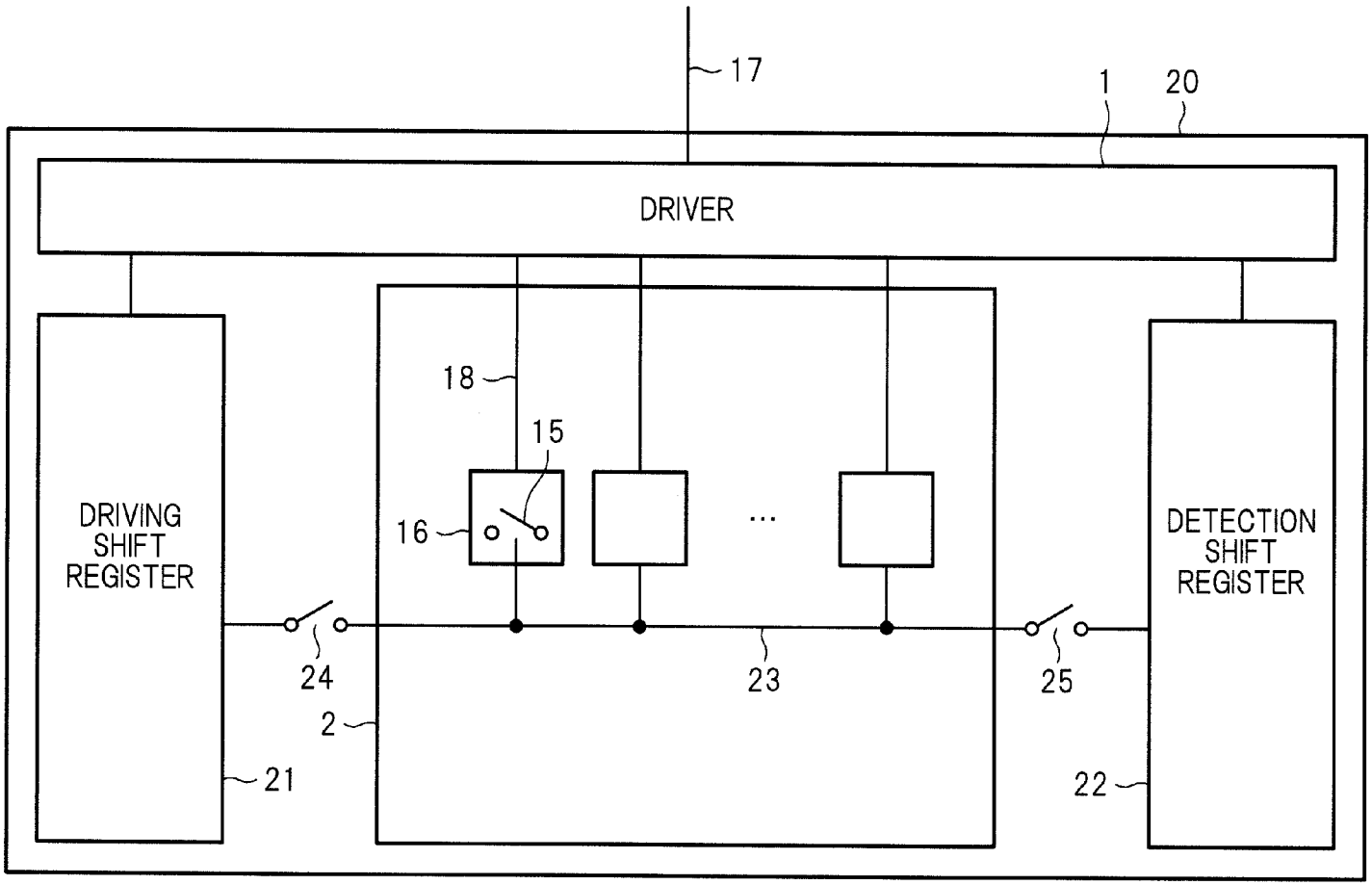
FIG. 2 is a diagram showing a configuration of a panel including a driver and a display section of the display device according to the first embodiment of the invention.

FIG. 2 shows the configuration of a panel 20 including the driver 1 and display section 2 shown in FIG. 1. The panel 20 includes a driving shift register 21 and a detection shift register 22, for controlling the display section 2. These shift registers 21 and 22 are controlled by the driver 1. The panel 20 performs two operations which are a display operation and a detection operation. These operations refer to two contradictory operations for writing and reading the state of the same pixel, and therefore, the two operations are not performed at the same time. A control line 23 that controls the switches 15 of the pixels 16 is connected to the driving shift register 21 via a switch 24 and connected to the detection shift register 22 via a switch 25. The driving shift register 21 performs the display operation, namely the operation of writing data to pixels, and in this case, the switch 24 is turned on, and the switch 25 is turned off. The detection shift register 22 performs the detection operation, namely the operation of reading the states of pixels, and in this case, the switch 24 is turned off, and the switch 25 is turned on.

Figure 3:
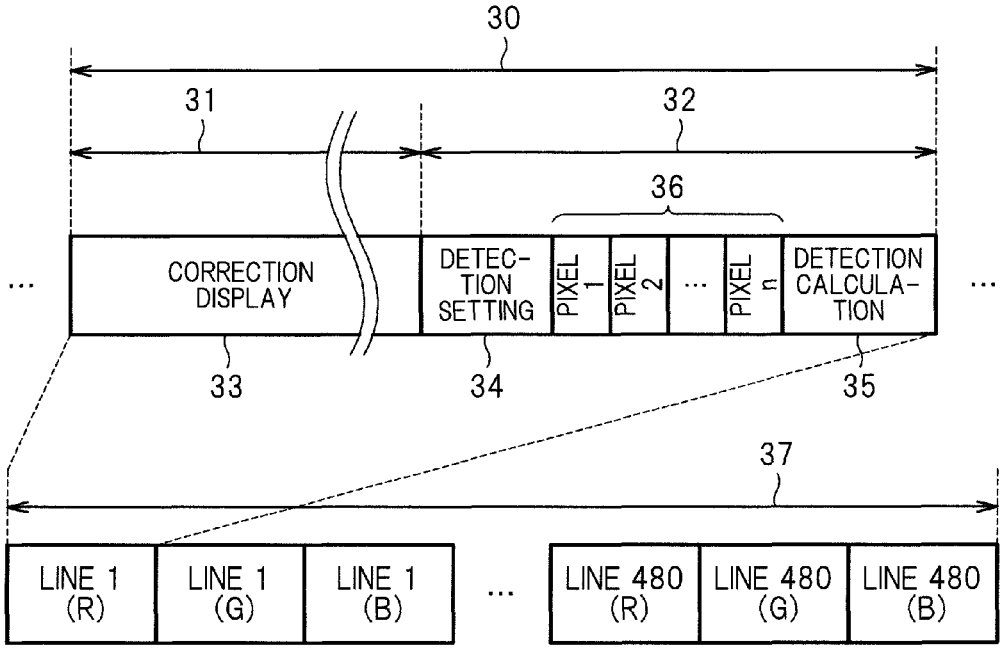
FIG. 3 is a diagram showing display and detection timings in the display device according to the first embodiment of the invention.

FIG. 3 shows the display and detection timings. In the first embodiment, a detection operation corresponding to one line is performed during one display frame. Although one frame generally includes a display period and a blanking period, in the present embodiment, the blanking period is used as a detection period, and one display frame 30 includes a display period 31 and a detection period 32. During the display period 31, an operation of correction display 33 is performed based on a correction value obtained from detection results. The detection period 32 includes respective periods corresponding to detection setting 34, detection calculation 35, and one-color detection line 36. During the period of detection setting 34, various settings of the switches or the like in the panel used for the detection are made. During the period of detection calculation 35, the correction value calculation unit 8 calculates the correction value from the detection results. During the period of one-color detection line 36, the number of pixels corresponding to one horizontal line is detected. One detection frame 37 refers to a period in which all horizontal lines are detected. In the present embodiment, although a detection operation corresponding to one horizontal line of one color is performed during one display frame, a detection operation corresponding to plural horizontal lines or plural colors may be performed during one display frame.

[Details of Correction Method]

Figure 4:
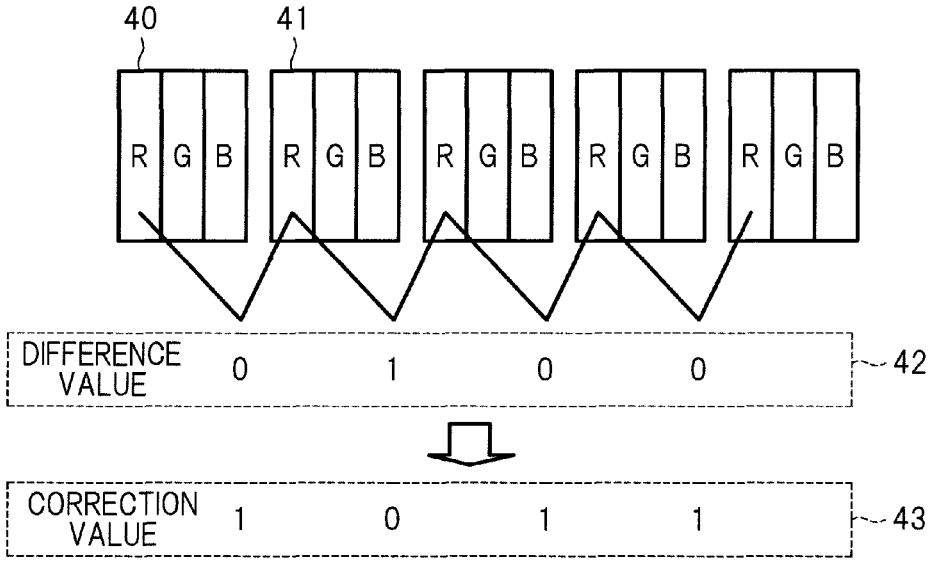
FIG. 4 is a diagram showing a correction value calculation method in the display device according to the first embodiment of the invention.

FIG. 4 is a diagram showing a correction value calculation method. Unit pixels 40 and 41 for color display represent a color configuration of each pixel. In this example, although an RGB arrangement is used as an arrangement configuration of pixels, other arrangements may be used. The states of pixels having the same color in the respective unit pixels are detected. That is, the pixel states are detected from an R pixel of the unit pixel 40, an R pixel of the unit pixel 41, and R pixels of the other unit pixels, for example. The values of two adjacent pixels are compared based on the detection results obtained for one horizontal line. The difference results are stored in a result 42. For example, if the detection results of the R pixels of the unit pixels 40 and 41 are the same (within a predetermined voltage), the difference value thereof becomes 0, which is stored in a corresponding address in the result 42. On the other hand, if the difference values between the pixels are different, the difference value thereof is stored in a corresponding address in the result 42. When the detection of one horizontal line is completed, a correction value 43 is calculated from the result 42. In the first embodiment, the larger value is used as a reference value. Therefore, difference values between "1" which is the largest value in the result 42 and the respective values in the result 42 are used as a correction value 43, which is "1, 0, 1, 1" from the left in the figure. The correction value 43 may be determined based on the larger value of the difference values 42 and may be determined based on the smaller value thereof.

Figures 5A, 5B:
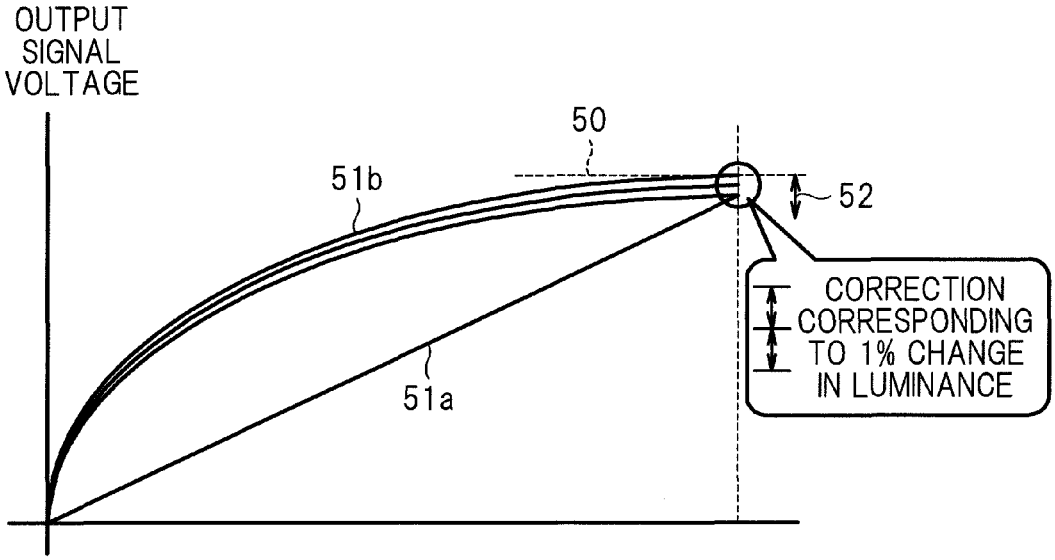
FIGS. 5A and 5B are diagrams showing tone characteristic control during the correction in the display device according to the first embodiment of the invention.

FIGS. 5A and 5B are diagrams showing tone characteristic control during the correction. Specifically, FIG. 5A is a graph showing tone characteristic control during the correction, and FIG. 5B is a table showing examples of a detection voltage and a correction voltage corresponding to a deterioration ratio of pixels. The detection voltages and the correction voltages corresponding to the deterioration ratios of pixels are not limited to the values shown in FIG. 5B. In FIG. 5A, a line 51*b* represents the gamma correction characteristic corresponding to the correction value 43 in FIG. 4.

In FIG. 5A, the horizontal axis represents inputs (tone data), and the vertical axis represents output signal voltages, namely analog voltages output based on tone data. A reference voltage 50 represents the maximum voltage in the state of no deterioration. Moreover, a line 51*a* in FIG. 5A represents the characteristic before gamma correction and the line 51*b* represents the characteristic after gamma correction. It should be noted that the curves of the lines 51*a* and 51*b* are examples, and the values thereof are not limited thereto.

When no deterioration occurs between adjacent pixels, a correction amount 52 is set to the reference voltage 50. The correction amount 52 is used for adjusting the reference voltage 50 of the output signal voltage with respect to a certain degree of luminance deterioration.

For example, by setting the difference value 42 shown in FIG. 4 in advance to a value corresponding to the degree of deterioration of pixels shown in FIG. 5B, the correction voltage corresponding to the correction value 43 "1, 0, 1, 1" can be obtained. That is, when a difference between the detection voltages of the R pixels of the unit pixel 40 and the unit pixel 41 is equal to or smaller than 15 mV, the deterioration ratio is equal to or smaller than 1%, and therefore, the difference value becomes 0. On the other hand, when a difference between the detection voltages of the R pixels of the unit pixel 41 and the next unit pixel is in the range of 15 to 30 mV, the deterioration ratio is in the range of 1 to 2%, and therefore, the difference value becomes 1. Similarly, the difference values are determined based on the detection voltages shown in FIG. 5B. Subsequently, in order to calculate the correction amount 43 based on the obtained difference values 42, a subtraction between the maximum value in the difference values 42 and the respective difference values is performed, whereby the above-described correction value 43 is obtained. Then, the tone dynamic range of pixels other than a pixel where deterioration is detected is decreased based on this correction value 43, whereby a difference in luminance and color of video near the boundary between the deteriorated pixel (burnt-in portion) and the non-deteriorated pixels (portions where no burn-in occurs) is made unnoticeable.

In the description above, although the tone dynamic range of all pixels other than the deteriorated pixel or the neighboring pixels thereof is decreased based on the luminance of the deteriorated pixel, the invention is not limited to this. For example, the tone dynamic range of pixels in which deterioration is detected may be corrected based on the luminance of pixels where no deterioration is detected. In this case, the tone dynamic range of the deteriorated pixels can be increased and corrected so that the correction voltages corresponding to the deterioration ratio of the pixels in which deterioration is detected are determined based on the above-described difference values 42.

According to such a correction method of the first embodiment, the reference voltage of a tone voltage, namely the tone dynamic range is adjusted. In this case, the correction amount 52 is corrected based on the values in the table shown in FIG. 5B. Specifically, the correction amount 52 is corrected based on the value in the column of correction voltage 55 corresponding to the values in the columns of deterioration ratio 53 and detection voltage 54 shown in FIG. 5B.

Figure 6:
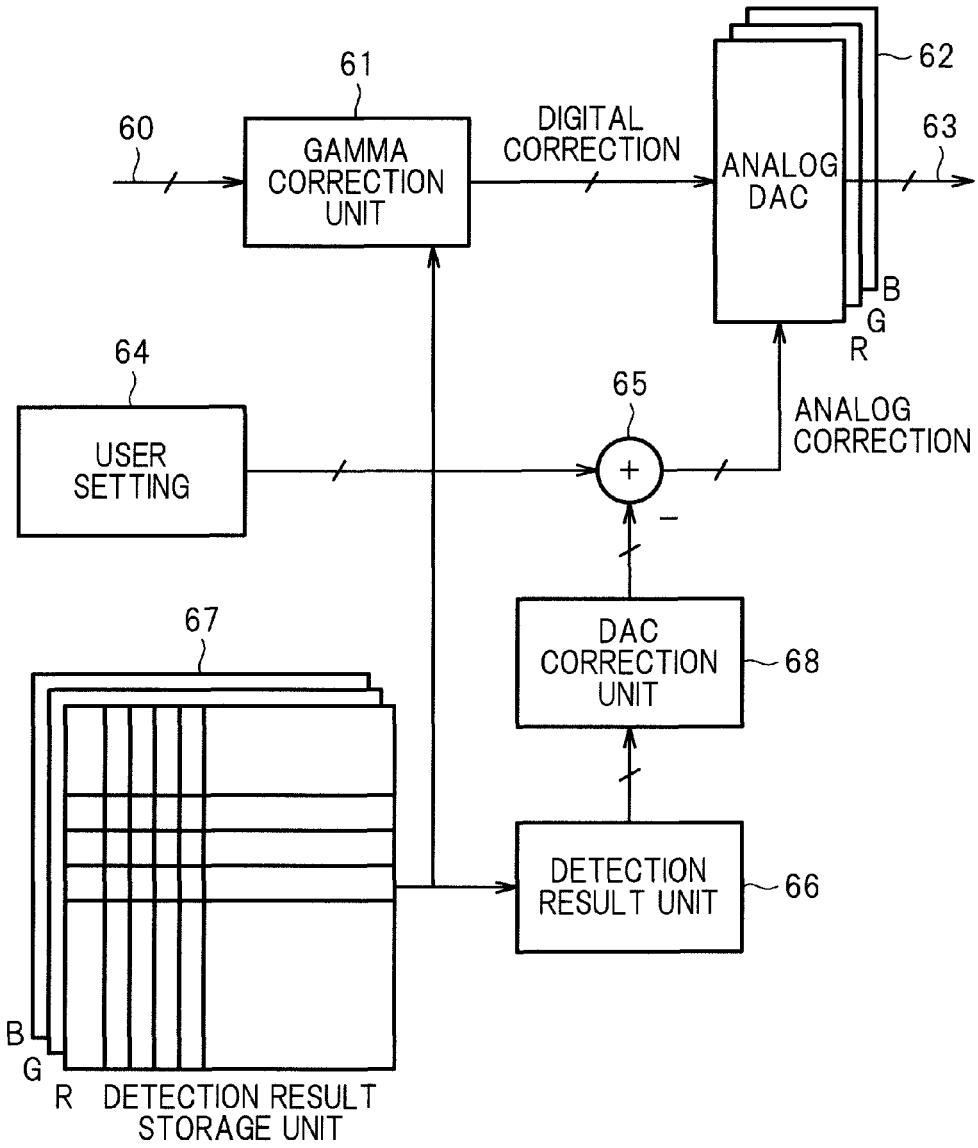
FIG. 6 is a diagram showing the detailed configuration of a gamma control unit and the configuration associated with correction data generation in the display device according to the first embodiment of the invention.

FIG. 6 is a diagram showing the detailed configuration of the gamma control unit 11 and the configuration associated with correction data generation. According to the correction method of the first embodiment, since the characteristics of R, G, and B pixels are corrected independently, the driver 1 can be driven for realizing the display of each pixel, namely dot-sequential driving, and the correction can be made for each pixel.

As shown in FIG. 6, the gamma control unit 11 of the first embodiment includes a gamma correction unit 61 that performs gamma correction and burn-in correction, which are well known in the related art, for each pixel with respect to input data 60 which are display data. Moreover, the gamma control unit 11 of the first embodiment includes the following configurations for correcting the tone dynamic range of an analog DAC 62, which are a user setting 64, an adding unit 65, a detection result unit 66, a detection result storage unit 67, and a DAC correction unit 68.

First, the flow of data provided when no correction is made will be described. The gamma correction unit 61 subjects the input data 60 to gamma correction. The results of this digital correction are converted to analog values by the analog DAC 62, and display data are created as output data 63. In addition, the user setting 64 is provided as a function for enabling users to freely set a setting value. When no correction is made, the setting value is passed through the adding unit 65 and used as an analog adjustment value in the analog DAC 62.

Next, the flow of data provided when correction is made will be described. The gamma correction unit 61 subjects the input data 60 to display luminance correction and gamma correction based on a correction value stored in the detection result storage unit 67 provided in the memory 10. The results of this digital correction are converted to analog values by the analog DAC 62, and display data are created as output data 63.

In addition, the user setting 64 is provided as a function for enabling users to freely set a setting value. When correction is made, the adding unit 65 calculates the sum of the output of the DAC correction unit (output correction circuit) 68 and the user setting value. The addition result is used as an analog adjustment value (output range setting means) in the analog DAC 62, namely an adjustment value of an allowed output range (tone dynamic range) of the analog voltage of the analog DAC 62. In this case, since the characteristics of the R, G, and B pixels are detected independently, the detection result unit 66 reads the detection results in the corresponding addresses from the detection result storage unit 67 provided in the memory 10 in which the correction values which are the detection results of the respective pixels are stored. Then, based on the read correction values, the detection result unit 66 outputs a value (hereinafter referred to as a reference correction value) that is necessary for the DAC correction unit 68 to obtain the correction voltage shown in FIG. 5B. Although the analog DAC 62 of the first embodiment is capable of performing analog adjustment using digital signals input from the adding unit 65, the invention is not limited to this, and the analog DAC 62 which is capable of performing analog adjustment using analog signals may be used. In this case, for example, the adding unit 65 converts digital signal to analog signals.

[Description of Operation]

Figure 7:
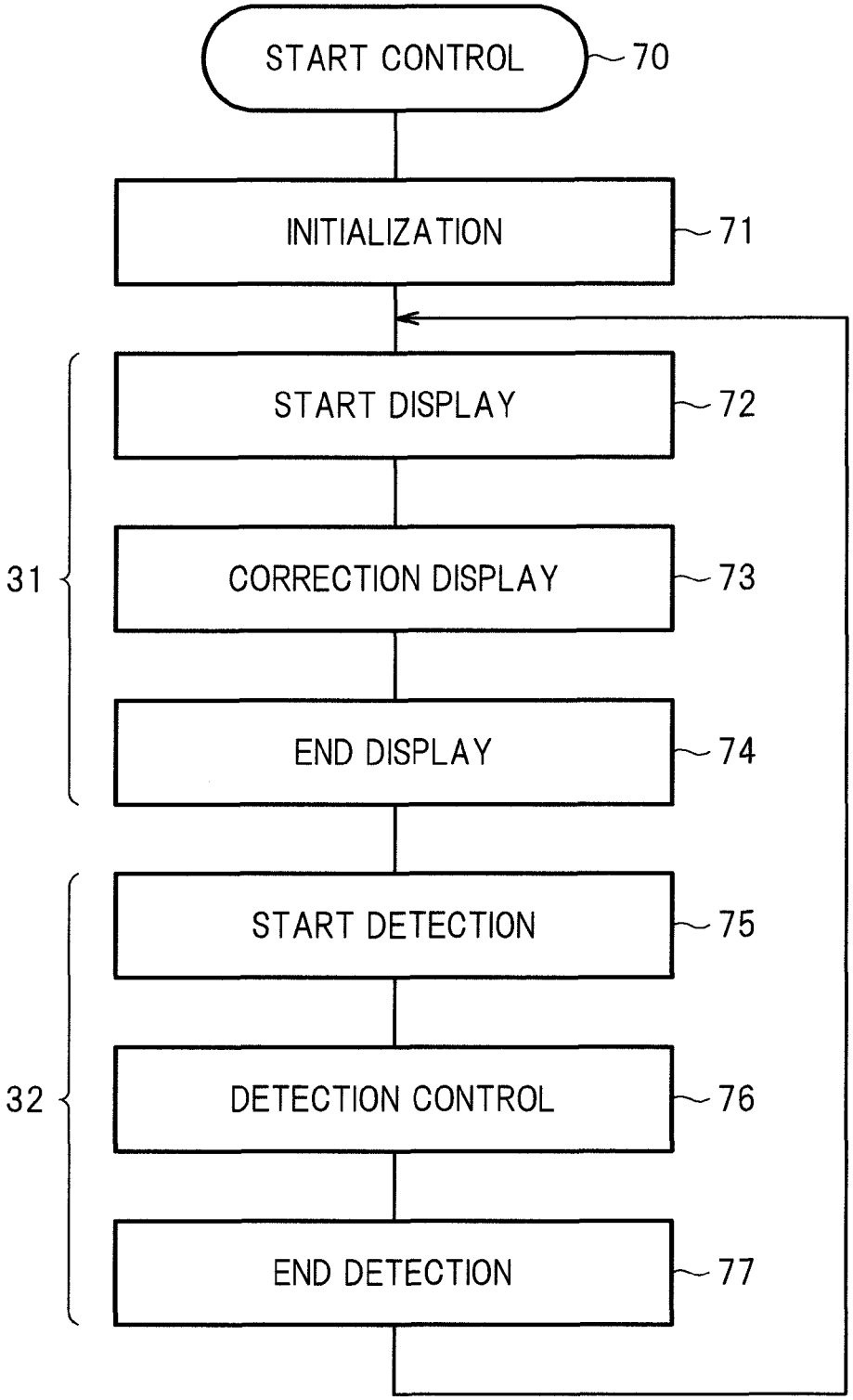
FIG. 7 is a flowchart of an overall control in the display device according to the first embodiment of the invention.

FIG. 7 shows a flowchart of a control for displaying pixels. When the display operation starts in step 70, the system 3 is initialized in step 71. After that, during the running of the system 3, the display period 31 and the detection period 32 are repeated.

In the display period 31, the display operation starts in step 72, correction display is performed in step 73, and the display operation ends in step 74. The correction display enables users to make settings and may have a function by which the settings can be switched during operation. For example, by allowing the settings to be selected on an on-screen menu or the like, the on/off of the correction display can be appropriately selected.

In the detection period 32, the detection operation starts in step 75, detection control is performed in step 76, and the detection operation ends in step 77. As described above, the operations in the display period 31 and the detection period 32 are performed within one display frame.

Figure 8:
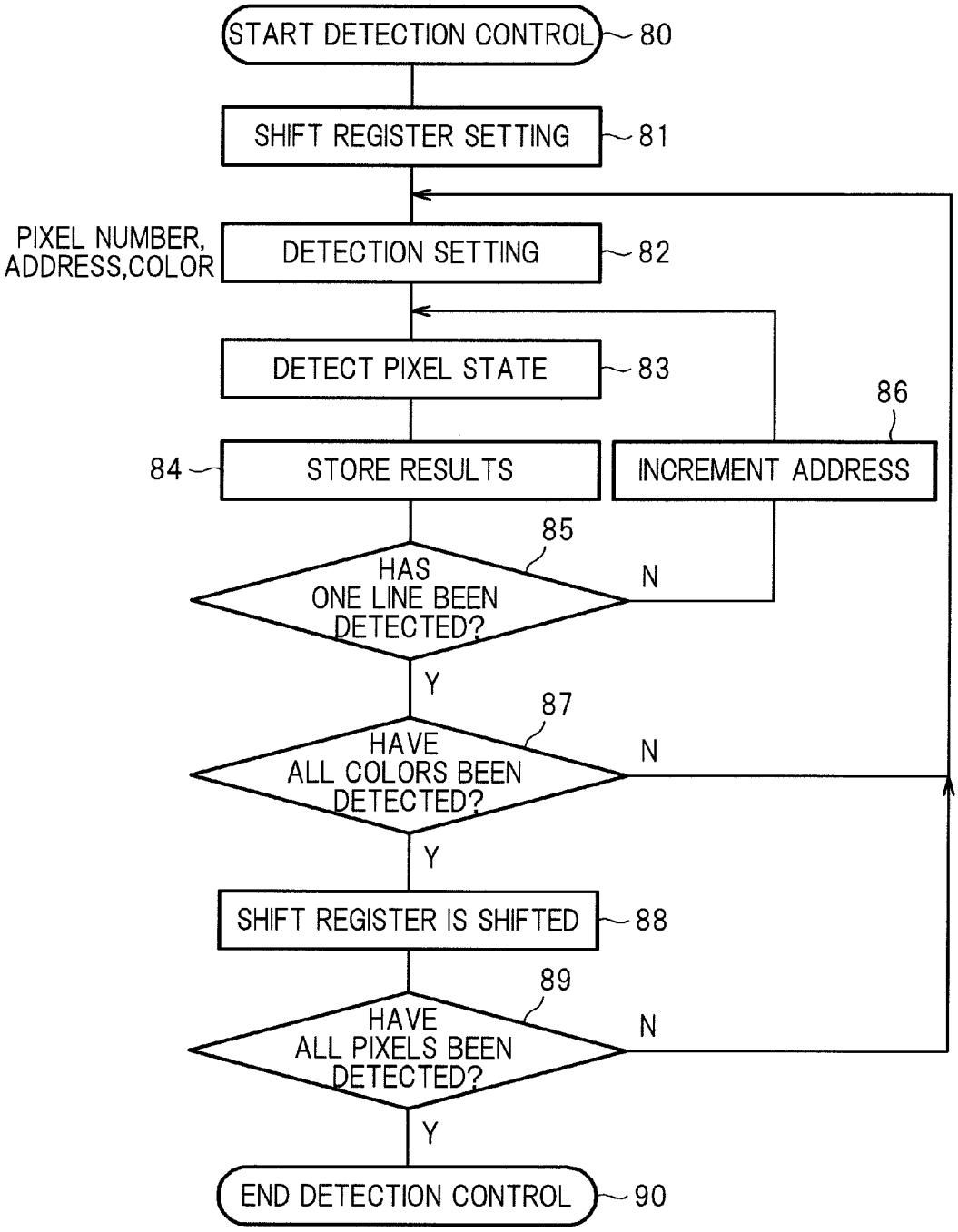
FIG. 8 is a flowchart of a detection control in the display device according to the first embodiment of the invention.

FIG. 8 shows a flowchart of a control for detecting pixels and shows the detailed operation of step 76 shown in FIG. 7. When the detection control starts in step 80, the shift register 22 (FIG. 2) is initialized in step 81. After that, a pixel number, a detection address, a detection color, and the like are set to a detection circuit in step 82, and the states of pixels are detected in step 83. In step 84, detection results are stored in the memory 10. In step 85, it is determined whether or not one horizontal line has been detected. If one horizontal line has not been detected, the detection address is incremented in step 86, and the flow returns to step 83. If it is determined in step 85 that one horizontal line has been detected, it is determined in step 87 whether or not all colors in one horizontal line have been detected. If all colors have not been detected, the flow returns to step 83. If it is determined in step 87 that all colors have been detected, the shift register 22 is shifted in step 88. In step 89, it is determined whether or not all pixels have been detected. If all pixels have not been detected, the flow returns to step 83. If it is determined in step 89 that all pixels have been detected, the detection control ends in step 90.

Figure 9:
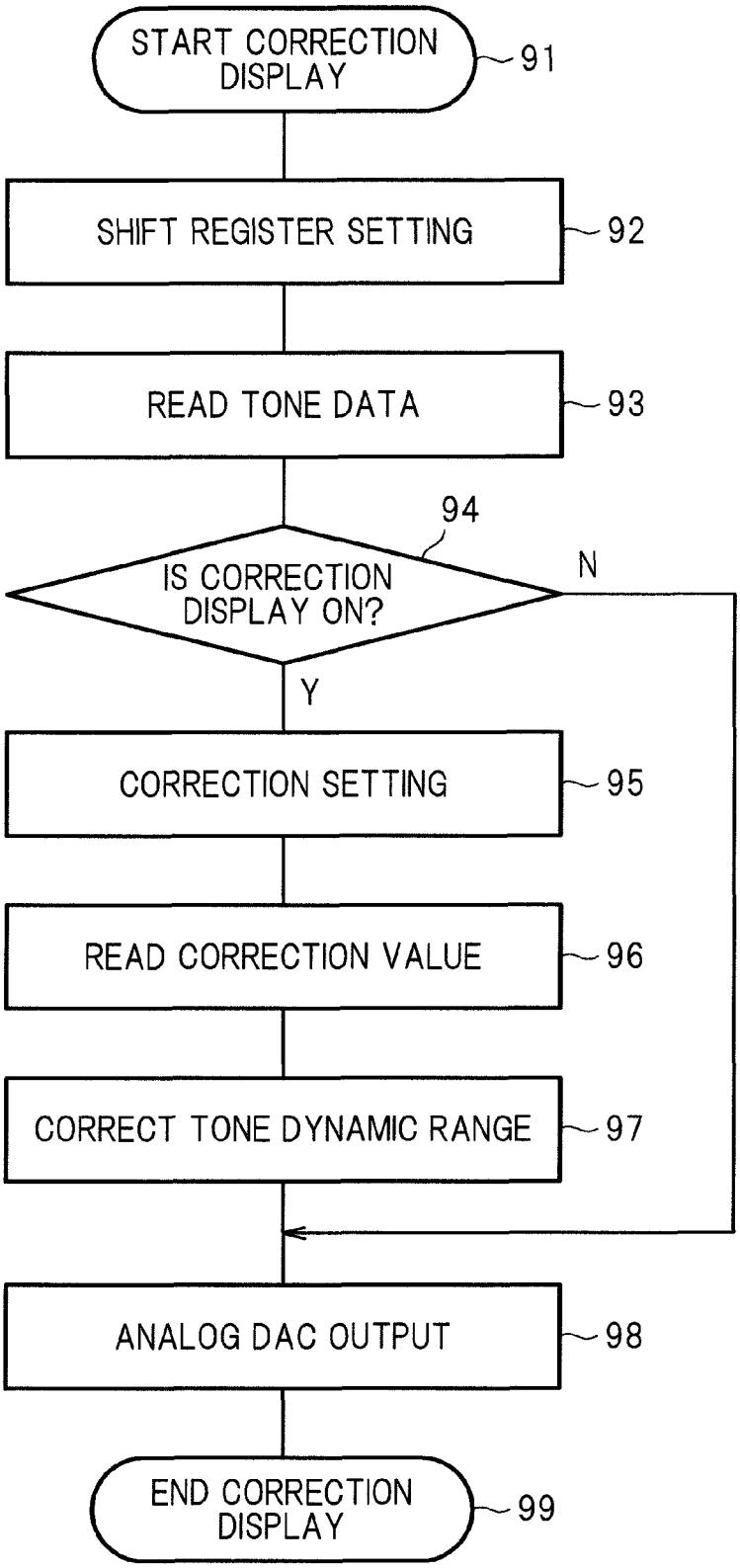
FIG. 9 is a flowchart of a display control in the display device according to the first embodiment of the invention.

FIG. 9 shows a flowchart of a control for performing the correction display and shows the detailed operation of step 73 shown in FIG. 7. When a correction display control starts in step 91, the driving shift register 21 (FIG. 2) is set in step 92. After that, tone data which are converted from display data are read in step 93. In step 94, it is determined whether the correction display is turned on or off. If the correction display is turned on, read addresses from the memory 10 serving as the detection result storage unit 67, and the like are set, and the correction values are read from the memory 10 in step 96. In step 97, the reference voltage 50 serving as the tone dynamic range of the analog DAC 5 is corrected based on the correction values read in step 96. After that, an analog voltage corresponding to the tone data is output from the analog DAC 5 in step 98, and the correction display operation ends in step 99. If it is determined in step 94 that the correction display is turned off, the correction display operation is omitted, and the flow proceeds to step 98. In this case, an analog voltage corresponding to tone data in the non-corrected state is output from the analog DAC 5, and the correction display operation ends in step 99.

Next, the operation of the display device according to the first embodiment of the invention shown in FIGS. 1 to 9 will be described based on the flowcharts of FIGS. 7 to 9.

When the display device of the present embodiment is powered on, the control operation starts (step 70), and the respective control units constituting the driver 1 and the display section 2 are initialized (step 71). After that, the display data 17 such as image display data and display conditions which are input from the external system 3 or the like in order to start display are latched into the input conversion unit 4*a* of the data generation unit 4 (step 72). The display data 17 latched into the input conversion unit 4*a* are converted to image data (tone data) corresponding to the display device. Then, the image data are corrected based on the gamma value (γ value) of the display device by the gamma correction unit 61 of the gamma control unit 11. In this case, in the display device of the first embodiment, the image data (tone data) are corrected based on a gamma value which has been corrected based on a correction amount calculated in the previous display operation, for example. The corrected image data (tone data) are subjected to conversion such as tone correction and color correction by the output conversion unit 4*b* and then output to the analog DAC 5. Then, the analog DAC 5 outputs an analog voltage corresponding to the tone data. The outputs of the analog DAC 5 are sequentially output to the panel 20 side through the detection switch 6. The analog voltage is written to the pixel control units 14 of the respective pixels 16 on the first horizontal line (in the first direction) to the last (for example, 480-th) horizontal line, and an image display operation is performed. In this case, in the display device of the first embodiment, the output of the analog DAC 5, specifically the tone dynamic range of the analog DAC 5 is also corrected based on the correction amount, and the analog voltage is output within the corrected tone dynamic range.

The tone dynamic range is corrected in the following manner. As shown in FIG. 9, after the display device is powered on, the driving shift register 21 is initialized (step 92) during the initialization of step 71. After that, tone data are input from the output conversion unit 4*b* of the data generation unit 4 (step 93). In this case, in the display device of the first embodiment, the use of the correction display can be selected on an on-screen menu, and when the correction display is selected (step 94), the operation of step 95 is executed. The addresses of the memory 67 necessary for reading the correction value 43 corresponding to the display location (display addresses) of the tone data read in step 93 are set to the detection result unit 66. The read addresses set at that time are the addresses of the memory 67 storing the correction value 43 for each of the R, G, and B pixels. After that, the detection result unit 66 reads the correction value from the memory 67, which is the detection result storage unit, based on the set address information and outputs the read correction value to the DAC correction unit 68 of the correction value calculation unit 8 (step 95).

Based on the correction value input from the detection result unit 66, first, the DAC correction unit 68 reads a reference correction value which is converted from the input correction value. After that, the DAC correction unit 68 outputs the converted reference correction value to the adding unit 65 (step 96). The conversion by the DAC correction unit 68 can be performed, for example, by referring to table data corresponding to input correction value, and the table data are stored in the memory 10 (not shown) in which the relationship between the correction value for the degree of deterioration shown in FIG. 5B and the reference correction value which is the value necessary for obtaining the correction voltage for correcting the reference voltage of the analog DAC 5 is stored in a table form.

The adding unit 65 outputs the sum of the value set by the user setting 64 and the reference correction value input from the DAC correction unit 68 to an input unit for correcting the reference value of the analog DAC 62. With the input of the sum from the adding unit 65, the allowed output range of the analog voltage of the analog DAC 62 has a value corresponding to the correction value, and the tone dynamic range is corrected (step 97).

When the correction of the tone dynamic range is completed, the analog voltage corresponding to the corrected image data (tone data) from the gamma correction unit 61 is output as a driving signal (the output data 63) of a corresponding pixel (step 98). After that, the correction display for the corresponding pixel ends (step 99).

In step 94 described above, the use of the correction display can be selected on an on-screen menu, and when the correction display is not selected, an analog voltage corresponding to the image data (tone data) from the data generation unit 4, 61 is output as a driving signal (the output data 63) of a corresponding pixel (step 98). After that, the correction display for the corresponding pixel ends (step 99).

When the above-described correction display operation ends (step 74), the display period 31 within one display frame (one frame period) 30 ends, and the detection period (blanking period) 32 begins (step 75).

In the detection period 32, the detection control operation starts (step 76). First, the detection shift register 22 is set to an initial value (step 81), and values corresponding to a pixel number per one horizontal line, addresses, target pixels subjected to detection (for example, red (R) pixels as the first target pixels), and the like are set to the detection shift register 22 (step 82). In this case, the switch 24 is turned off, and the switch 25 is turned on, whereby the control line 23 is connected to the detection shift register 22.

When the setting is completed, a control signal from the detection shift register 22 is output to the control line 23, and the switch 15 is turned on/off by the control signal from the detection shift register 22. Thus, the first pixel is connected to the detection power source 9, and the pixel state is detected by the detection unit 7 (step 83). The detected pixel state is temporarily stored in the memory 67 serving as the detection result storage unit, for example (step 84). The detection results obtained in this step are managed for each pixel as shown in FIG. 6. When the first pixel has been detected, it is determined whether or not the number of detected pixels has reached the number of pixels corresponding to one horizontal line (step 85). If the number of detected pixels has not reached the number of pixels corresponding to one horizontal line, the address is incremented so as to detect an adjacent pixel on the same horizontal line as the first pixel (step 86), and the flow returns to step 83. By repeating the operations of steps 83 to 86, the respective pixels having the same color corresponding to one horizontal line are sequentially detected.

On the other hand, in the step 85, if the number of detected pixels has reached the number of pixels corresponding to one horizontal line, the period of detection calculation 35 shown in FIG. 3 begins, and a difference value between two adjacent pixels is calculated based on the detection value stored in the detection result storage unit 67. After that, difference values corresponding to one horizontal line are compared. For example, using the maximum difference value as a reference, differences between the maximum difference value and the difference values of the respective pixels are overwritten and stored in the detection result storage unit 67 as the correction values. After that, it is determined whether or not all pixels corresponding to a corresponding color (for example, red (R) pixels) corresponding to one horizontal line have been detected (step 87). If all pixels of each of the colors R, G, and B have not been detected, the flow returns to step 82, and setting is made so as to detect pixels of the next color (for example, green (G) pixels). After that, the detection period 32 ends (step 77), and the display period 31 for the next one display frame (one frame period) 30 begins.

The display period 31 and the detection period 32 of one display frame 30 are repeated, and when it is determined in step 87 that the detection operation is completed for the green (G) and blue (B) pixels corresponding to one horizontal line, the value of the detection shift register 22 is shifted, and the pixels of a next one horizontal line are set as detection targets (step 88). After that, the value of the detection shift register 22 is examined, and it is determined whether all pixels have been detected (step 89). If it is determined that all pixels have not been detected, the flow returns to step 82, and a setting is made so as to detect pixels of a next one horizontal line (for example, red (R) pixels). After that, the detection period 32 ends (step 77), and the display period 31 of a next one display frame (one frame period) 30 begins. On the other hand, if it is determined in step 89 that all pixels have been detected, the detection control ends (step 90), and the detection period 32 ends (step 77). After that, the above-described display operation and detection operation are repeated.

As described above, in the display device of the first embodiment, during periods excluding the display period in one display frame, the switch performs switching so that power is supplied from the detection power source to pixels, the detection circuit estimates the state of each pixel from the detection signal thereof, the detection result unit 66 reads the correction value corresponding to the degree of deterioration of the corresponding pixels from the detection result storage unit 67 based on the obtained pixel state, the DAC correction unit 68 generates the reference correction value of the tone dynamic range corresponding to the correction value, and the adding unit 65 calculates the sum of the obtained reference correction value and the user setting value, whereby the tone dynamic range of the analog DAC 5, 62 is corrected. Thus, the display of deteriorated pixels can be corrected without causing tone loss and changing color balance. Moreover, since the correction is made at positions between adjacent unit pixels for color display where burn-in is the greatest, when the pixels on the entire screen are deteriorated substantially uniformly, it is possible to obtain an extraordinary advantage that a long-term burn-in phenomenon can be corrected.

Second Embodiment

Figure 10:
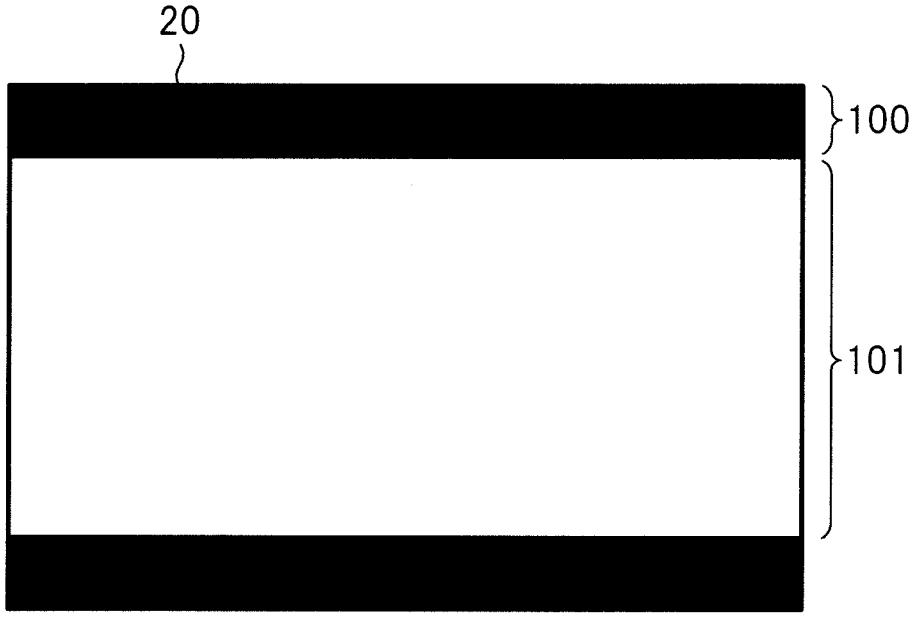
FIG. 10 is a diagram showing a display region of a display device according to a second embodiment of the invention.

FIG. 10 is a diagram showing a pixel region, in which pixels contributing to display are formed, in a display device according to a second embodiment of the invention. Particularly, the display device of the first embodiment has a dot-sequential panel configuration, whereas the display device of the second embodiment has a line-sequential panel configuration. In addition, regarding the display, the display device of the first embodiment displays images on the entire screen, whereas the display device of the second embodiment divides and uses the screen into a display region 101 and a non-display region 100. That is, a panel 20 includes the non-display region 100 and the display region 101. For example, the present embodiment is applied to a case where a pixel size of the panel is different from the aspect ratio of display. In this case, a black strip-like region appears in the non-display region 100, and burn-in is likely to appear on the boundary between the display region 101 and the non-display region 100. The present embodiment relates to correction of the burn-in at this boundary portion. Since the panel has a line-sequential configuration, the correction is collectively made for one line of pixels in the horizontal direction.

Figure 11:
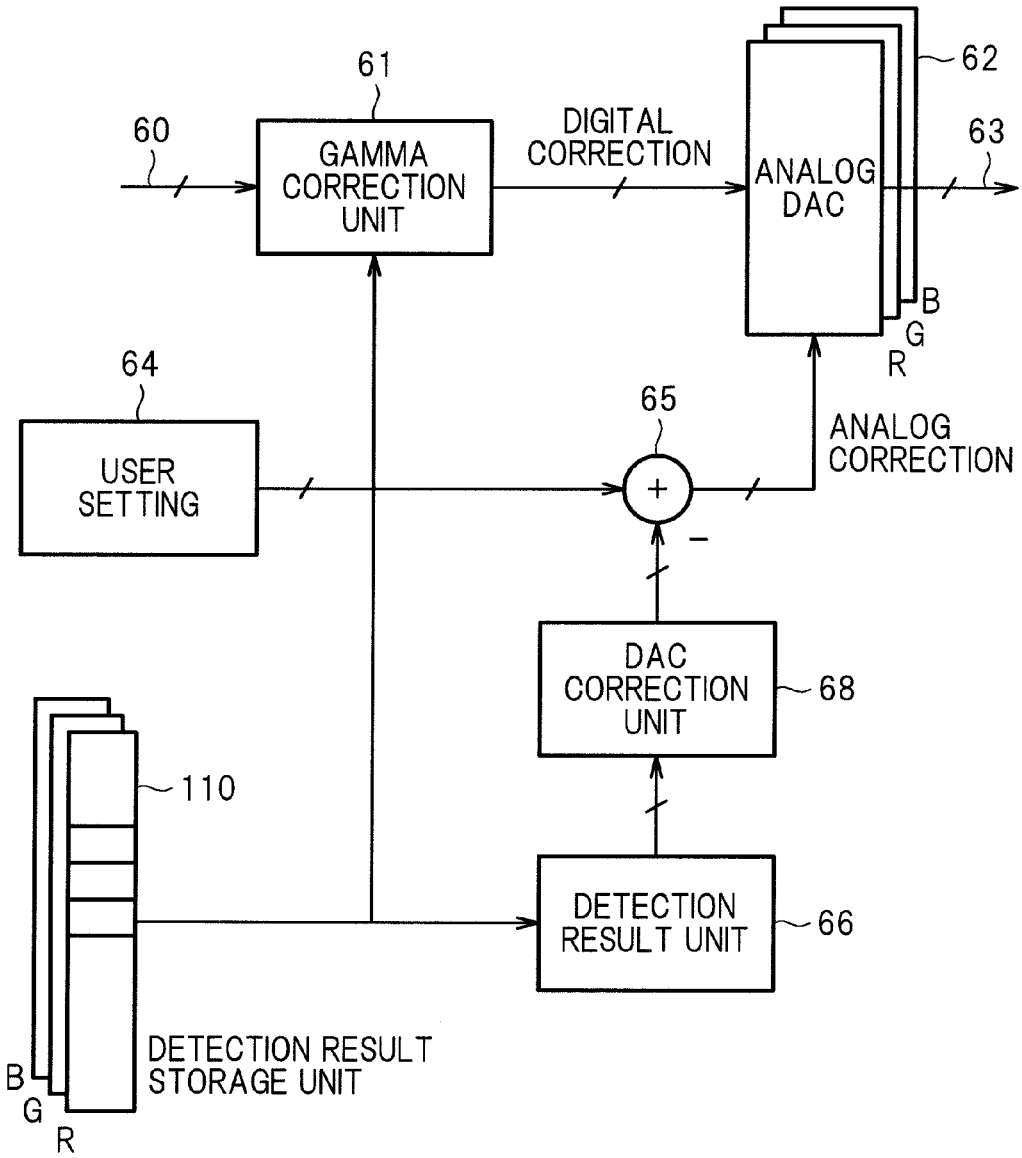
FIG. 11 is a diagram showing the detailed configuration of a gamma control unit and the configuration associated with correction data generation in the display device according to the second embodiment of the invention.

FIG. 11 a diagram showing the detailed configuration of a gamma control unit and the configuration associated with correction data generation in the display device according to the second embodiment of the invention. The gamma control unit has substantially the same basic configuration as the display device of the first embodiment. In this correction, since the characteristics of R, G, and B pixels are corrected independently, the driver 1 can be driven for realizing display of each horizontal line, namely line-sequential driving, and the correction can be made for each horizontal line.

As shown in FIG. 11, similarly, the gamma control unit 11 of the second embodiment includes the gamma correction unit 61, the user setting 64, the adding unit 65, the detection result unit 66, the DAC correction unit 68, and a detection result storage unit 110.

First, the flow of data provided when no correction is made will be described. The gamma correction unit 61 subjects the input data 60 to gamma correction. The results of this digital correction are converted to analog values by the analog DAC 62, and display data are created as the output data 63. In addition, the user setting 64 is provided as a function for enabling users to freely set a setting value. When no correction is made, the setting value is passed through the adding unit 65 and used as an analog adjustment value in the analog DAC 62.

Next, the flow of data provided when correction is made will be described. The gamma correction unit 61 subjects the input data 60 to display luminance correction and gamma correction based on a correction value read from the detection result storage unit 110 provided in the memory 10. The results of this digital correction are converted to analog values by the analog DAC 62, and display data are created as the output data 63.

In addition, the user setting 64 is provided as a function for enabling users to freely set a setting value. When correction is made by the user setting 64, the adding unit 65 calculates the sum of the value of the user setting 64 and the reference correction value obtained via the DAC correction unit 68 from the detection result unit 66. The addition result is used as an analog adjustment value (adjustment value of the tone dynamic range) in the analog DAC 62. In this case, since the characteristics of the R, G, and B pixels are detected independently, the detection result unit 66 reads and uses the detection results in the corresponding addresses from the detection result storage unit 110 provided in the memory 10 in which the correction values which are the detection results of the respective pixels are stored. In the present embodiment, since the detection is performed in a line-sequential manner, it is only necessary to provide the detection result storage units 110 for storing the detection results by the number of horizontal lines.

Figure 12:
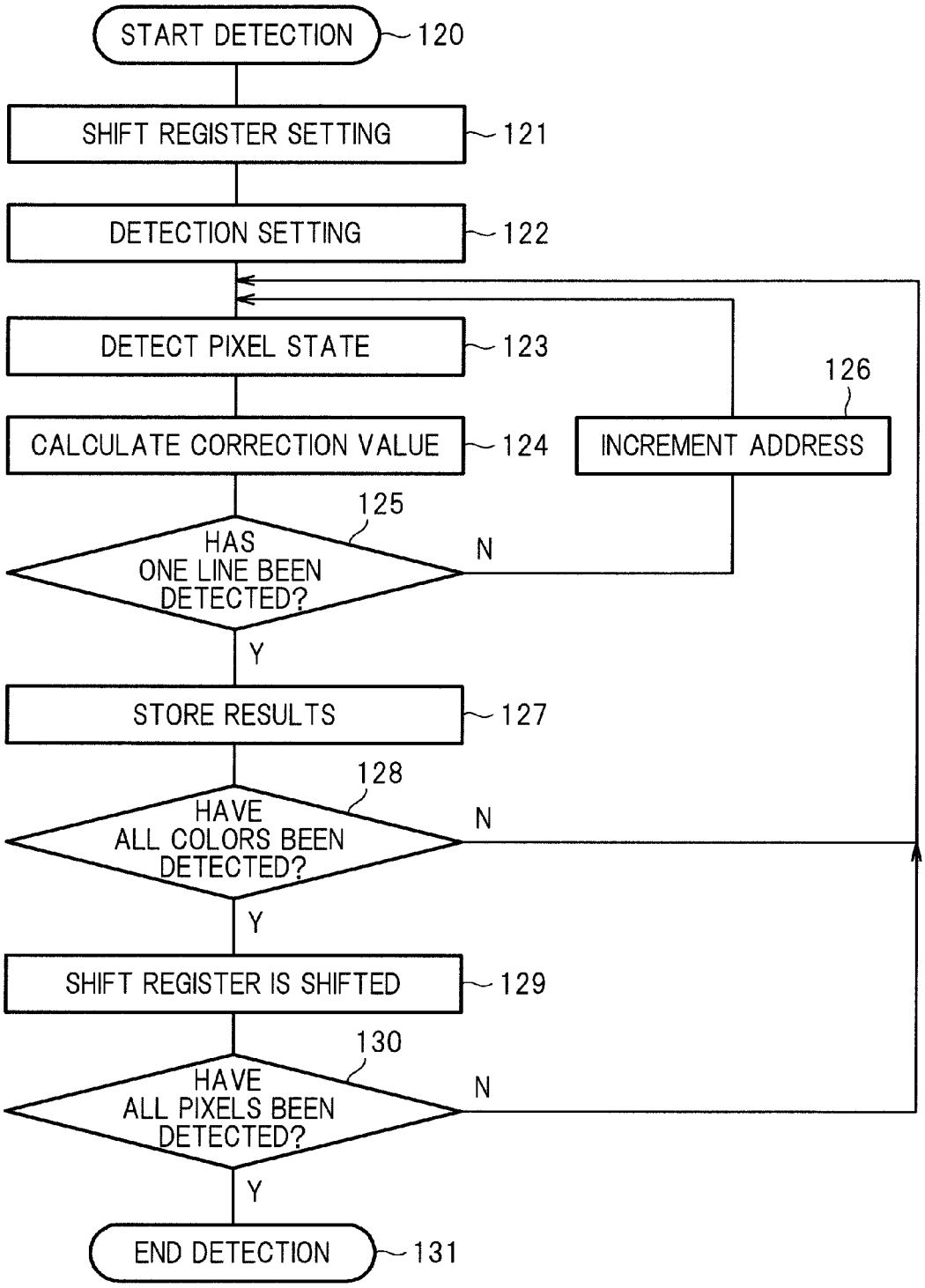
FIG. 12 is a flowchart of a display control in the display device according to the second embodiment of the invention.

FIG. 12 shows a flowchart of a control for detecting pixels in the display device of the second embodiment of the invention. When the detection control starts in step 120, the shift register 22 (FIG. 2) is initialized in step 121. After that, a pixel number, a detection address, a detection color, and the like are set to a detection circuit in step 122, and the states of pixels are detected in step 123. In step 124, correction values are calculated. As a calculation example of the correction values, a method may be used in which information of a pixel which experiences maximum deterioration in the horizontal line is stored and the value thereof is used as a correction value. Regarding the calculation of correction values, in addition to the method where the maximum deterioration pixel is used as the reference, other methods may be used. For example, a method where the minimum deterioration pixel is used as the reference, and a method where the average of the degrees of deterioration (correction values) of the pixels in one horizontal line is calculated, and the correction values are subtracted from the average.

In step 125, it is determined whether or not one horizontal line has been detected. If one horizontal line has not been detected, the detection address is incremented in step 126, and the flow returns to step 123. If it is determined in step 125 that one horizontal line has been detected, the correction values are stored in the memory 10 in step 127. After that, it is determined in step 128 whether or not all colors in one horizontal line have been detected. If all colors have not been detected, the flow returns to step 123. If it is determined in step 128 that all colors have been detected, the display shift register 22 is shifted in step 129. In step 130, it is determined whether or not all pixels have been detected. If all pixels have not been detected, the flow returns to step 123. If it is determined in step 130 that all pixels have been detected, the detection control ends in step 131.

Next, the operation of the display device according to the second embodiment of the invention will be described based on the flowcharts of FIGS. 10 to 12. As described above, the display device of the second embodiment has the same configuration as the display device of the first embodiment, except that the display device of the second embodiment has a line-sequential panel configuration and divides and uses the panel into the display region and the non-display region. Therefore, in the following description, the details of the operation of calculating the correction values of the pixels on the same horizontal line and the operation of using the same correction value for correction of the pixels on the same horizontal line will be described.

As shown in FIG. 11, in the display device of the second embodiment, the correction values corresponding to the respective pixels of the colors R, G, and B are stored for each horizontal line in the detection result storage units 110 provided in the memory 10. Therefore, in the display period of the display device of the second embodiment, similarly to the first embodiment, the display data (input data) 60 are subjected to gamma correction and burn-in correction by the gamma correction unit 61, and the corrected display data (tone data) are input to the analog DAC 62. Then, analog voltages corresponding to the tone data are output from the analog DAC 62.

In this case, in the display device of the second embodiment, since the correction values are stored for each horizontal line in the detection result storage unit 110, the reading of the correction values from the detection result storage unit 110 by the detection result unit 66 and the conversion of the correction values to the reference correction values by the DAC correction unit 68 are also performed for each horizontal line. Therefore, the reference correction value is input for each horizontal line to the adding unit 65, the sum of the reference correction value and the user setting 64 is calculated by the adding unit 65, and the sum is input to the analog DAC 62. As a result, the analog voltages which are the corrected tone dynamic ranges of the outputs of the analog DAC 62 for each horizontal line are output to the respective pixels of the colors R, G, and B on the first horizontal line to the last (for example, 480-th) horizontal line.

On the other hand, in the detection period, the same detection operation as the first embodiment is performed in steps 120 to 126 except for step 124. In step 124, the correction value is calculated based on the detected pixel state. Specifically, the correction value obtained by calculation is compared with the correction value of adjacent pixels, and the larger correction value is selected. In the following comparing calculation, the correction value obtained by calculation is compared with the correction value obtained by the previous comparing calculation.

The largest correction value in one horizontal line is obtained in steps 120 to 126, and this correction value is stored in the detection result storage unit 110 (step 127). The operations in subsequent steps 128 to 131 are the same as those in steps 87 to 90 of the first embodiment.

As described above, in the display device of the second embodiment, during periods excluding the display period in one display frame, the switch performs switching so that power is supplied from the detection power source to pixels, the detection circuit estimates the state of each pixel from the detection signal thereof, calculates a correction amount, and calculates a correction amount of a corresponding horizontal line from a correction amount for one horizontal line, the detection result unit 66 reads the correction amount corresponding to the degree of deterioration of the horizontal line on which the corresponding pixels are formed from the detection result storage unit 110, the DAC correction unit 68 generates the reference correction value which is correction data of the tone dynamic range corresponding to the correction amount, and the adding unit 65 calculates the sum of the obtained reference correction value and the user setting value, whereby the tone dynamic range of the analog DAC 5, 62 is corrected. Thus, in addition to the advantage of the first embodiment, it is possible to obtain an extraordinary advantage that the capacity of the detection result storage unit 110 storing the correction amount, namely the capacity of the memory 10 can be reduced greatly.

Third Embodiment

Figure 13:
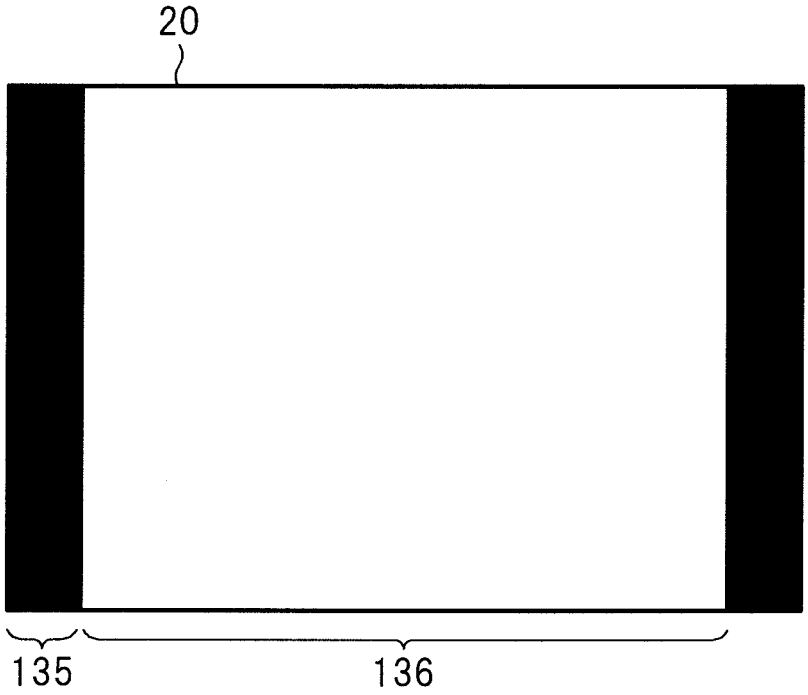
FIG. 13 is a diagram showing a display region of a display device according to a third embodiment of the invention.

FIG. 13 is a diagram showing a pixel region, in which pixels contributing to display are formed, in a display device according to a third embodiment of the invention. The display device of the third embodiment has a dot-sequential panel configuration similarly to the panel of the first embodiment. In addition, regarding the display, the display device of the third embodiment divides and uses the screen into a display region and a non-display region similarly to the second embodiment. That is, the panel 20 includes a non-display region 135 and a display region 136. For example, the present embodiment is applied to a case where the pixel size of the panel is different from the aspect ratio of display. In this case, a black strip-like region appears in the non-display region 135, and burn-in is likely to appear on the boundary between the display region 136 and the non-display region 135. The present embodiment relates to correction of the burn-in at this boundary portion.

Regarding the configuration associated with correction data generation, the third embodiment has the same configuration as the second embodiment except that the detection result unit sequentially outputs the correction values in accordance with the positions of the pixels in the horizontal direction. Therefore, detailed description thereof will be omitted. In the gamma correction unit of the third embodiment, it should be noted that the correction values stored in the detection result storage unit 110 provided in the memory 10 are the correction values corresponding to the pixel position in the horizontal direction of the screen.

Figure 14:
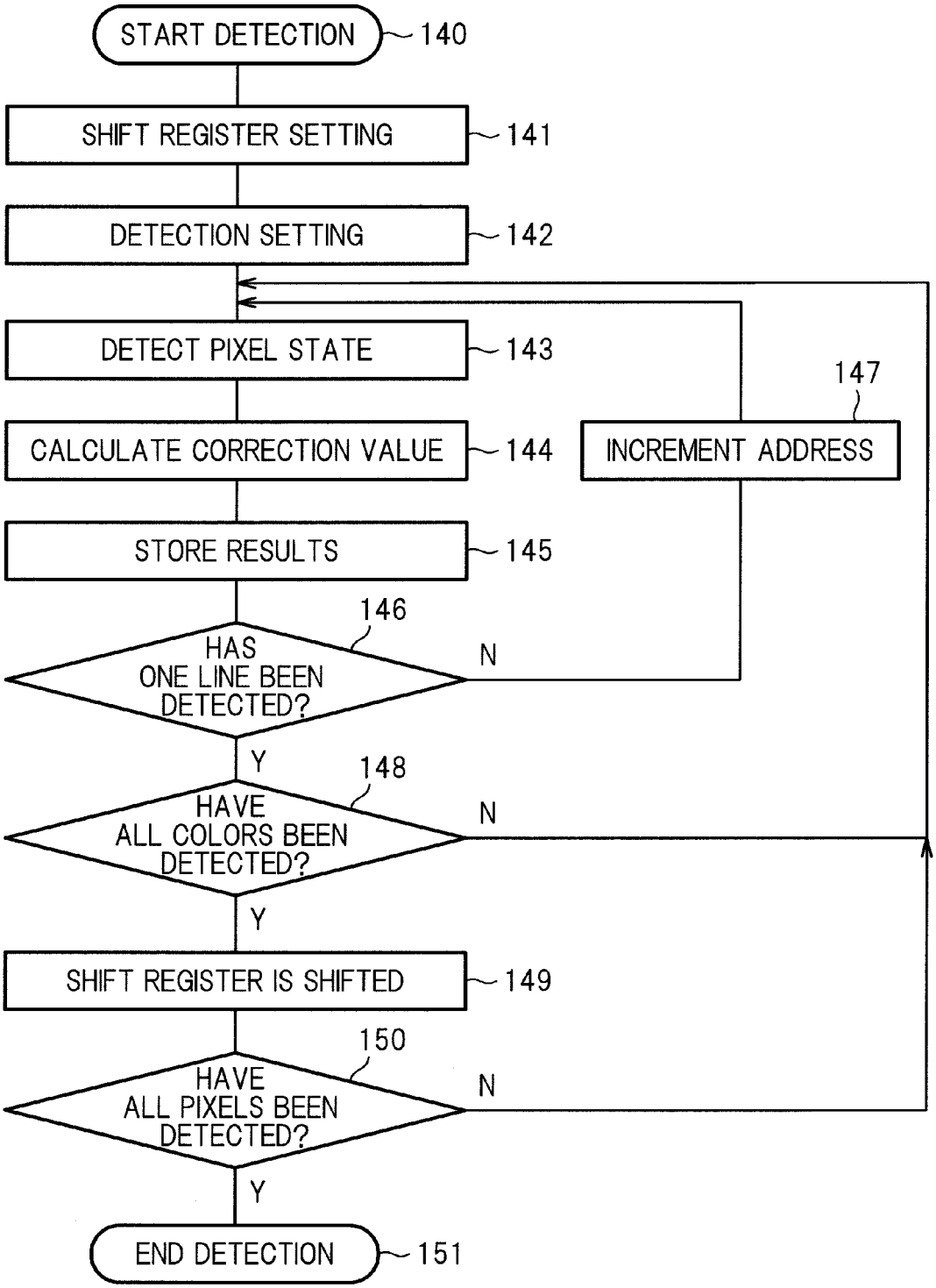
FIG. 14 is a flowchart of a detection control in the display device according to the third embodiment of the invention.

FIG. 14 shows a flowchart of a control for detecting pixels in the display device of the third embodiment of the invention. It should be noted that the gamma correction unit has the same configuration as the gamma correction unit of the second embodiment shown in FIG. 11. When the detection control starts in step 140, the shift register 22 (FIG. 2) is initialized in step 141. After that, a pixel number, a detection address, a detection color, and the like are set to a detection circuit in step 142, and the states of pixels are detected in step 143. In step 144, correction values are calculated. As a calculation example of the correction values, a method may be used in which information of a pixel which experiences maximum deterioration on the line in the vertical direction (hereinafter referred to as a vertical line) is stored and the value thereof is used as a correction value. That is, in step 144, first, the correction values corresponding to the detection voltages are calculated. After that, the correction values stored in the memory 10 serving as the detection result storage unit 110 are retrieved, and the correction value on the vertical line the horizontal position of which is the same as the detected pixel is read. The read correction value is compared with the correction value calculated from the detection voltage, and the larger correction value is used as the correction value for the corresponding vertical line. In step 145, the correction value calculated in step 144 is stored in the detection result storage unit 110. In step 146, it is determined whether or not one horizontal line has been detected. If one horizontal line has not been detected, the detection address is incremented in step 147, and the flow returns to step 143. If it is determined in step 146 that one horizontal line has been detected, it is determined in step 148 whether or not all colors in one horizontal line have been detected. If all colors have not been detected, the flow returns to step 143. If it is determined in step 148 that all colors have been detected, the shift register 22 is shifted in step 149. In step 150, it is determined whether or not all pixels have been detected. If all pixels have not been detected, the flow returns to step 143. If it is determined in step 150 that all pixels have been detected, the detection control ends in step 151. By the above-described steps, the correction values for each vertical line are calculated by the detection operation performed for the horizontal lines.

Next, the operation of the display device according to the third embodiment will be described based on the flowcharts of FIGS. 13 and 14. As described above, the display device of the third embodiment has the same configuration as the display device of the first embodiment, except that the panel has a dot-sequential configuration and the panel is used in a state of being divided into the display region 136 and the non-display region 135. Therefore, in the following description, the details of the operation of correcting the pixels in the non-display region 135 and the display region 136, which is different from the display device of the first embodiment, will be described.

As described above, in the display device of the third embodiment, the correction value corresponding to the respective pixels of the colors R, G, and B are stored for each vertical line in the detection result storage unit 110. Therefore, in the display period of the display device of the third embodiment, the display data (input data) 60 are subjected to gamma correction and burn-in correction by the data generation unit 61, and the corrected display data (tone data) are input to the analog DAC 62. Then, analog voltages corresponding to the tone data are output from the analog DAC 62.

In this case, in the display device of the third embodiment, since the correction values are stored for each vertical line in the detection result storage unit 110, the reading of the correction values from the detection result storage unit 110 by the detection result unit 66 and the conversion of the correction values to the reference correction values by the DAC correction unit 68 are also performed for each pixel similarly to the first embodiment. Therefore, the reference correction value is input for each display pixel to the adding unit 65, the sum of the reference correction value and a value set by the user setting 64 is calculated by the adding unit 65, and the sum is input to the analog DAC 62. As a result, the analog voltages which are the corrected tone dynamic ranges of the outputs of the analog DAC 62 for each vertical line are output to the respective pixels of the colors R, G, and B on the first horizontal line to the last (for example, 480-th) horizontal line.

On the other hand, in the detection period, the same detection operation as the first embodiment is performed in steps 140 to 151 except for step 144. In step 144, as described above, first, the correction values corresponding to the detection voltages are calculated. After that, the correction values stored in the detection result storage unit 110 are retrieved, and the correction value on the vertical line the horizontal position of which is the same as the detected pixel is read. The read correction value is compared with the correction value calculated from the detection voltage, and the larger correction value is used as the correction value for the corresponding vertical line. In steps 140 to 151, the largest correction value in one vertical line is obtained.

As described above, in the display device of the third embodiment, during periods excluding the display period in one display frame, the switch performs switching so that power is supplied from the detection power source to pixels, the detection circuit estimates the state of each pixel from the detection signal thereof, calculates a correction amount, and calculates a correction amount for one vertical line from the correction amounts of the respective pixels, the detection result unit 66 reads the correction amount corresponding to the degree of deterioration of the vertical line on which the corresponding pixels are formed from the detection result storage unit 110, the DAC correction unit 68 generates the reference correction value of the tone dynamic range corresponding to the correction amount, and the adding unit 65 calculates the sum of the obtained reference correction value and the user setting value, whereby the tone dynamic range of the analog DAC 5, 62 is corrected. Thus, in addition to the advantage of the first embodiment, it is possible to obtain an extraordinary advantage that the capacity of the detection result storage unit 110 storing the correction amount, namely the capacity of the memory 10 can be reduced greatly. In addition, since the correction is made at positions between adjacent regions, namely the boundary between the non-display region 135 and the display region 136 where burn-in is the greatest, when the pixels on the entire screen are substantially uniformly deteriorated, it is possible to obtain an extraordinary advantage that a long-term burn-in phenomenon can be corrected.

In the above-described display devices of the first to third embodiments, the invention has been described for the case where it is applied to a display device in which organic EL elements are used as the display elements. However, the invention is not limited to a display device in which organic EL elements are used as the display elements. For example, the invention can be applied to a display device in which other self-emitting elements such as organic light-emitting diodes or inorganic EL elements are used as the display elements.

In addition, in the display devices of the first to third embodiments, whether the correction display will be performed or not and the correction amount of the tone dynamic range are determined based on the detection value obtained between pixels having the same color in the adjacent unit pixels among the unit pixels for color display disposed on one horizontal line. However, the invention is not limited to this. For example, the correction amount may be determined by comparing the detected values in both the horizontal and vertical directions.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device comprising a display section, a driver and signal lines connecting the display section and the driver, the display section including a plurality of pixels formed in a matrix where each of the pixels includes a self light-emitting element, the driver including:

a data generation circuit for generating tone data of the respective pixels from display data supplied from an external device;

a D/A converter coupled to the signal lines and coupled to receive the tone data from the data generation circuit, said D/A converter being configured to convert the tone data generated by the data generation circuit to an analog voltage and outputting the analog voltage to the signal lines;

a switch circuit for switching a direction of signal flow along the signal lines;

a detection circuit for detecting a signal of respective pixels obtained from the display section through the switch circuit; and a correction value calculation circuit for generating a correction value based on the signal of respective pixels detected by the detection circuit, wherein the driver further comprises an output correction circuit coupled to the D/A converter for setting an output range of the analog voltage to be output from the D/A converter in accordance with the correction value generated by the correction value calculation circuit, wherein the data generation circuit comprises a gamma correction circuit for performing, when generating the tone data from the display data to be provided to the D/A converter, a gamma correction and a display luminance correction based on the correction value, wherein the output correction circuit and the gamma correction circuit are separately connected to the D/A converter so that the output correction circuit sets the output range to be output from to D/A converter in accordance with the correction value, separately from the gamma correction performed by the gamma correction unit.

2. The display device according to claim 1, wherein each of the pixels comprises the self light-emitting element of a color selected from red, green, and blue, and the detection circuit detects the signal of respective pixels having self light-emitting elements of the same color which are formed along a row of the matrix.

3. The display device according to claim 2, wherein the driver comprises a memory for storing the correction value of the respective colors of red, green, and blue, and the output correction circuit is configured to set the range of the analog voltages to be output from the D/A converter in accordance with the correction value of the respective colors stored in the memory.

4. The display device according to claim 1, wherein a luminance of the pixel changes with a current flowing through the self light-emitting element.

5. The display device according to claim 1, wherein the signal of respective pixels correspond to an internal resistance of the self light-emitting element.

6. The display device according to claim 1 wherein an output signal of the output correction circuit coupled to the D/A converter for setting the output range of the analog voltage to be output from the D/A converter comprises an analog correction signal, and wherein an output signal from the gamma correction circuit for performing the gamma correction and the display luminance correction comprises a digital correction signal.

7. A display device comprising a display section, a driver and signal lines connecting the display section and the driver, the display section including a plurality of pixels formed in a matrix, where each of the pixels includes a self light-emitting element, the driver including:

a data generation circuit for generating tone data of the respective pixels from display data supplied from an external device;

a D/A converter coupled to receive the tone data from the data generation circuit, said D/A converter being configured to convert the tone data generated by the data generation circuit to an analog voltage and outputting the analog voltage to the signal lines;

a switch circuit for switching a direction of signal flow along the signal lines;

a detection circuit for detecting a signal of respective pixels obtained from the display section through the switch circuit; and a correction value calculation circuit for generating a correction value based on the signal of respective pixels detected by the detection circuit and further generating a correction value for a group of pixels arranged in a row or a column of the matrix based on the correction values of respective pixels in the group, wherein the driver comprises an output correction circuit coupled to the D/A converter for setting range of the analog voltage to be output from the D/A converter in accordance with the correction value for the group of pixels generated by the correction value calculation circuit, wherein the data generation circuit comprises a gamma correction circuit for performing, when generating the tone data from the display data to be provided to the D/A converter, a gamma correction and a display luminance correction based on the correction value for the group of pixels, wherein the output correction circuit and the gamma correction circuit are separately connected to the D/A converter so that the output correction circuit sets the analog voltage range to be output from the D/A converter in accordance with the correction value, separately from the gamma correction performed by the gamma correction circuit.

8. The display device according to claim 7, wherein each of the pixels comprises the self light-emitting element of a color selected from red, green, and blue, and the detection circuit detects the signal of respective pixels having self light-emitting elements of the same color which are formed along a row of the matrix.

9. The display device according to claim 8, wherein the driver comprises a memory for storing the correction value for the group of pixels of the respective colors of red, green, and blue, and the output correction circuit sets the output range of the analog voltages to be output from the D/A converter in accordance with the correction value for the group of pixels of the respective colors stored in the memory.

10. The display device according to claim 2, wherein the correction value calculation circuit is configured to calculate a difference between signals of two pixels having self light-emitting elements of the same color and adjacent to each other along a row of the matrix to generate the correction value.

11. The display device according to claim 8, wherein the correction value calculation circuit is configured to calculate a difference between signals of two pixels having self light-emitting elements of the same color and adjacent to each other along the row the matrix to generate the correction value.

12. The display device according to claim 7, wherein the correction value for the group of pixels is generated from the maximum or minimum of the correction values of respective pixels in the group.

13. The display device according to claim 7 wherein an output signal of the output correction circuit coupled to the D/A converter for setting the output range of the analog voltage to be output from the D/A converter comprises an analog correction signal, and wherein an output signal from the gamma correction circuit for performing the gamma correction and the display luminance correction comprises a digital correction signal.

* * * * *